US006342758B1

(12) United States Patent
Nakamura et al.

(10) Patent No.: US 6,342,758 B1
(45) Date of Patent: Jan. 29, 2002

(54) INLINE TYPE COLOR PICTURE TUBE

(75) Inventors: Tomoki Nakamura, Mobara; Kazunari Noguchi, Chiba; Syoji Shirai, Mobara, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/450,006

(22) Filed: Nov. 29, 1999

(51) Int. Cl.[7] ..... H01J 29/50
(52) U.S. Cl. ..... 313/414; 313/412
(58) Field of Search ..... 313/412, 413, 313/414, 426, 427–428, 444, 460

(56) References Cited

U.S. PATENT DOCUMENTS 5,739,631 A * 4/1998 Tojyou et al. ..... 313/414

* cited by examiner

*Primary Examiner*—Vip Patel
(74) *Attorney, Agent, or Firm*—Antonelli, Terry, Stout & Kraus, LLP

(57) ABSTRACT

In a color picture tube, a main lens of an electron gun is formed by a focus electrode to which a focus voltage, is applied an intermediate electrode to which an intermediate voltage between the focus voltage is applied and an anode voltage, and an anode electrode to which the anode voltage is applied. The focus electrode and the anode electrode are cylindrical, and plate electrodes are secured to the inner walls of the respective focus and anode electrodes, and the intermediate electrode has a construction in which a middle plate electrode is sandwiched between two cylindrical electrodes. Accordingly, it is possible to provide an electron gun which is easy to manufacture and has a superior focus performance and is reduced in performance variability.

12 Claims, 8 Drawing Sheets

INLINE TYPE COLOR PICTURE TUBE

BACKGROUND OF THE INVENTION

Color picture tubes used in computer terminals, personal computers and the like are required to have a good focus characteristic; that is to say, the spot size of an electron beam which collides against a fluorescent screen needs to be small. The spherical aberration of a main lens has a great influence on this focus characteristic. To decrease the spherical aberration, the effective diameter of the main lens needs to be increased. Various methods have heretofore been proposed to increase the effective diameter of the main lens. FIG. 1 shows an example of a conventional large-diameter electron gun, in which its main lens is formed between a focus electrode 4 and an anode electrode 6. A plate electrode 5 is formed in the inside of the focus electrode 4, and a plate electrode 7 is formed in the inside of the anode electrode 6. Holes through which to individually pass three electron beams are formed within the focus electrode 4 and the anode electrode 6 by the respective inner plate electrodes 5 and 7. A hole 4' which is formed in the focus electrode 4 and a hole 6' which is formed in the anode electrode 6 are holes common for three electron beams. Examples of this type of electron gun are disclosed in U.S. Pat. Nos. 5,146,133, 4,599,534 and 4,581,560. As another method of increasing a lens diameter, there is a method of arranging an intermediate electrode between an anode electrode and a focus electrode to reduce the potential gradient in the main lens, thereby enlarging the effective lens diameter.

An example of this method is shown in FIG. 2. Examples of this type of electron gun are disclosed in Japanese Patent Laid-Open Nos. 180648/1997 and 320485/1997. The method employing the intermediate electrode is useful in enlarging the lens diameter, but since the required number of components increases, there occur problems, such as the occurrence of astigmatism in an electron lens and the variability of focus or convergence characteristics due to variability in the assembly of components or variability in the assembly of electron guns.

SUMMARY OF THE INVENTION

An object of the present invention is to provide a large-diameter electron gun which is reduced in astigmatism and in the variability of focus or convergence characteristics. To this end, the present invention provides a construction which includes a focus electrode having a plate electrode in its inside, an anode electrode having a plate electrode in its inside and an intermediate electrode arranged between the focus electrode and the anode electrode. The focus electrode and the anode electrode are cylindrical electrodes, and the plate electrodes are secured to the inner walls of the respective cylindrical electrodes. The intermediate electrode is made of two cylindrical electrodes and a middle plate electrode, and the middle plate electrode is sandwiched between the two cylindrical electrodes. In accordance with this construction, it is possible to obtain a large-diameter electron gun which is unsusceptible to the influence of assembly and component accuracy and is reduced in the variability of its characteristics. Another object of the present invention is to decrease aberration to a further extent by specifying the ratio of the dimension of the intermediate electrode measured in a direction perpendicular to an inline direction to the length of the intermediate electrode measured in the axial direction of the electron gun. A further object of the present invention is to provide a large-diameter electron gun which is reduced in the variability of its focus characteristic by reducing the potential of the intermediate electrode to 52–58% of an anode potential.

DESCRIPTION OF THE PREFERRED EMBODIMENTS

Figure 1:
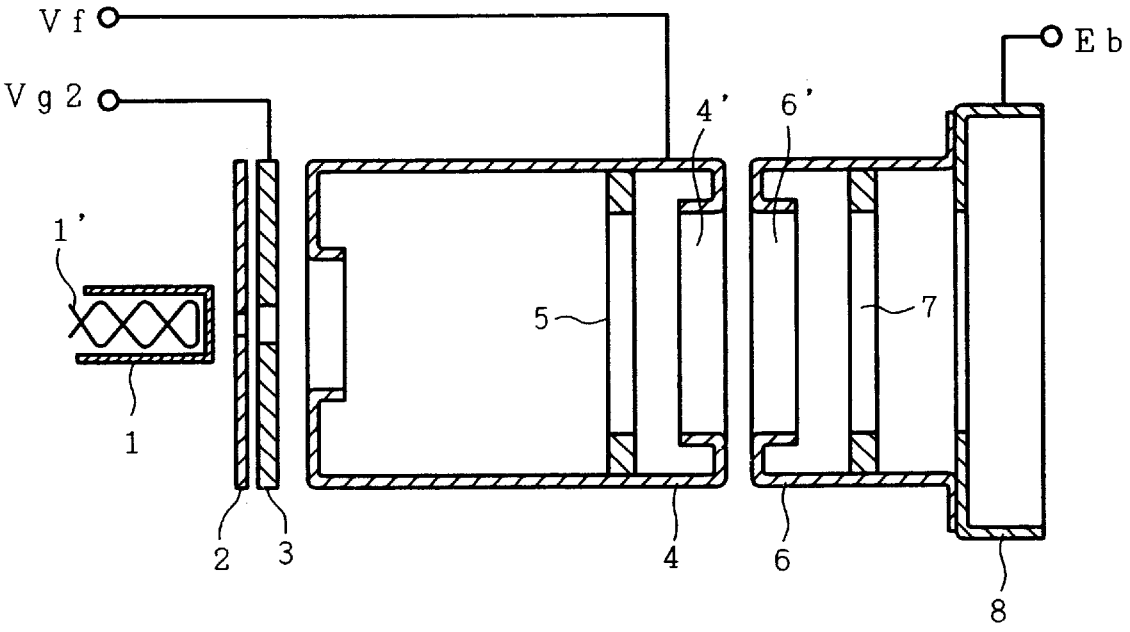
FIG. 1 PRIOR ART
FIG. 1 is a sectional view showing one example of a conventional large-diameter electron gun.
Figure 2:
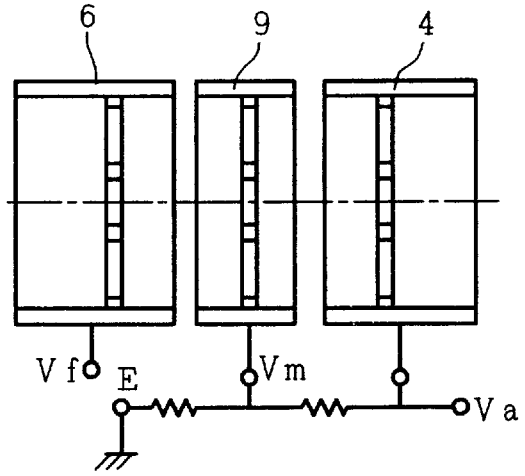
FIG. 2 PRIOR ART
FIG. 2 is a diagram which shows a conventional electron gun having an intermediate electrode.
Figure 3:
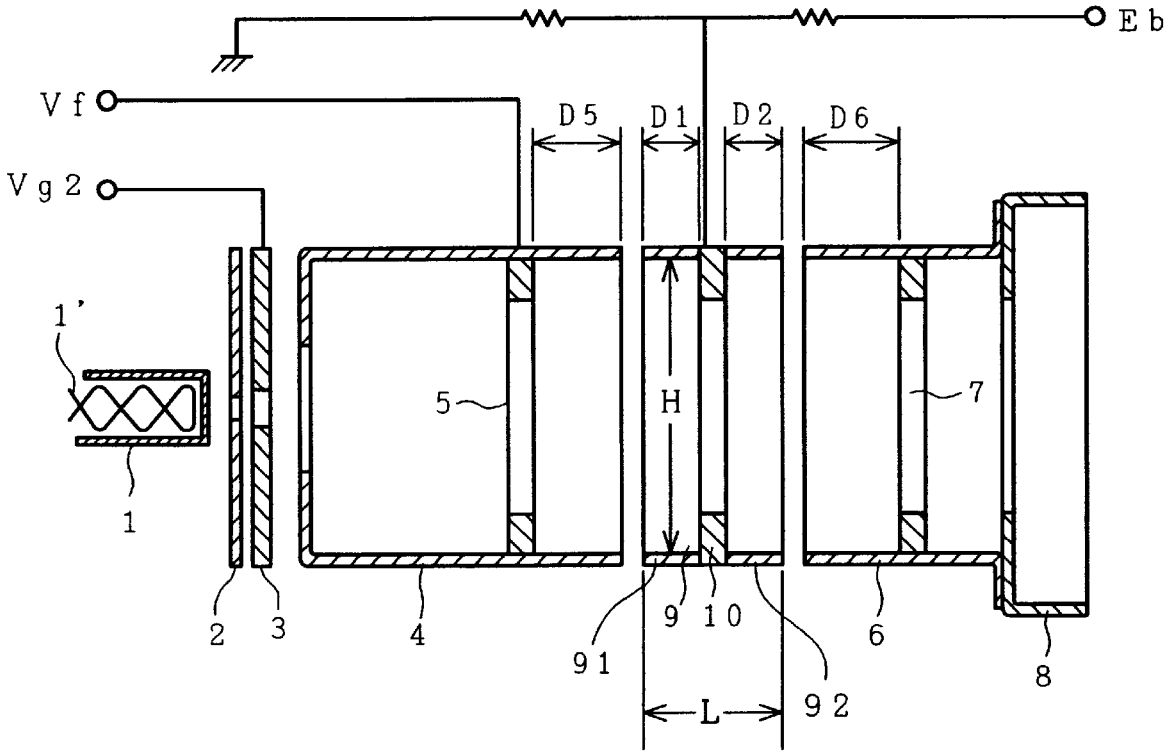
FIG. 3 shows a sectional view showing an electron gun according to the present invention.
Figure 4:
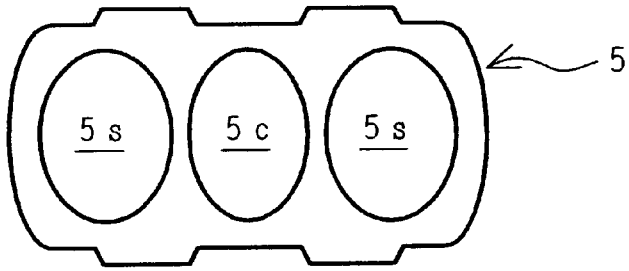
FIG. 4 is a plan view of an inner plate electrode installed in a focus electrode.
Figure 5:
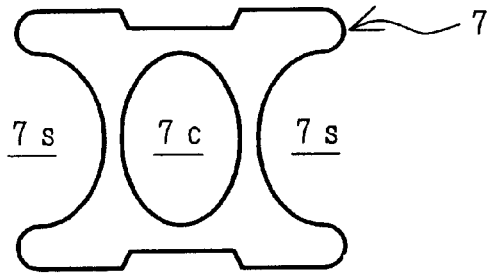
FIG. 5 is a plan view showing an example of an inner plate electrode installed in an anode electrode.
Figure 6:
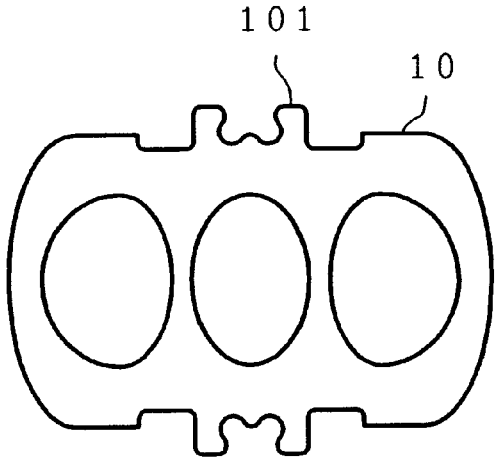
FIG. 6 is a plan view of a middle plate electrode according to the present invention.

FIG. 3 shows an electron gun according to the present invention. The electron gun generates three electron beams in its inline direction, and FIG. 3 shows a cross section taken in a direction perpendicular to the inline direction. A cathode 1 generates electron beams by being heated by a heater 1'. The electron beams pass through a control electrode 2, an accelerating electrode 3, a focus electrode 4, an intermediate electrode 9, an anode electrode 6 and a shield cup 8 and are directed toward a fluorescent screen. A main lens is formed by the focus electrode 4, the intermediate electrode 9 and the anode electrode 6. A focus voltage is applied to the focus electrode 4, an anode voltage, which is a maximum voltage, is applied to the anode electrode 6, and an intermediate voltage between the focus voltage and the anode voltage is applied to the intermediate electrode 9. Typical values of the anode voltage, the intermediate voltage and the focus voltage are, for example, 26 kV, 14.4 kV and 7.4 kV, respectively. An inner plate electrode 5 is secured to the inner wall of the focus electrode 4, and a plan view of the inner plate electrode 5 is shown in FIG. 4. The inner plate electrode 5 has three holes through which to pass three electron beams. An inner plate electrode 7 is secured to the inner wall of the anode electrode 6, and a plan view of the inner plate electrode 7 is shown in FIG. 5. A hole through which to pass a central electron beam is formed in the inner plate electrode 7, and both sides of the inner plate electrode 7 form holes through which to pass side beams, together with the inner wall of the anode electrode 6. The intermediate electrode 9 has a stacked structure made of a cylindrical electrode 91, a middle plate electrode 10 and a cylindrical electrode 92. A plan view of the middle plate electrode 10 is shown in FIG. 6. Although in the present embodiment the inner plate electrodes 5 and 7 and the middle plate electrode 10 differ in shape from one another, common components may also be used or the shapes of the respective plate electrodes may also be interchanged with one another, as required.

Figure 7:
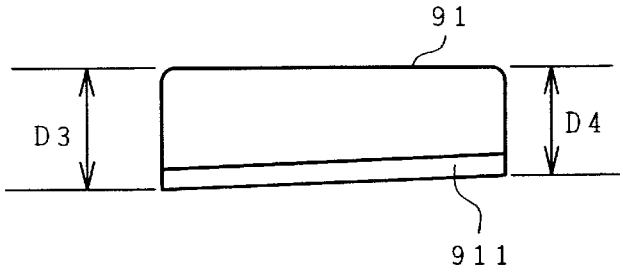
FIG. 7 is a diagram which shows an example of an asymmetrical cylindrical electrode component for the intermediate electrode.
Figure 8:
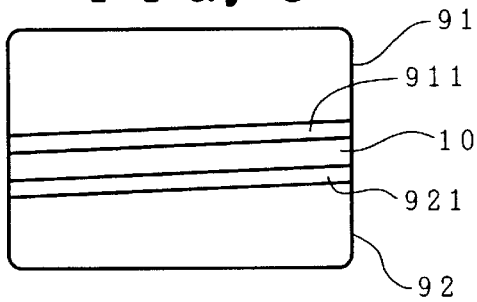
FIG. 8 is a diagram which shows an example in which the intermediate electrode is assembled so that asymmetrical cylindrical electrode components for the intermediate electrode compensate each other.

The variability of a position D5 of the inner plate electrode 5 in the focus electrode 4 and the variability of a position D6 of the inner plate electrode 7 in the anode electrode 6 exert a great influence on the variability of focus. This mainly appears as the difference in astigmatism between a central lens and side lenses, and, for example, if a position D5 or D6 shown in FIG. 3 varies by 0.01 mm, a focus voltage difference between the vertical direction and the horizontal direction appears as about 30 V. If a high assembly accuracy of 0.01 mm or less is to be maintained, it is necessary to adopt a construction in which the inner plate electrodes are welded to the inner wall of a cup electrode. On the other hand, the influence of a position D1 or D2 of the middle plate electrode 10 of the intermediate electrode 9 on the variability of the focus characteristic is not so large as the influence of the position D5 of the inner plate electrode 5 in the focus electrode 4 and the position D6 of the inner plate electrode 7 in the anode electrode 6, and the voltage variability is about 18 V under the same condition as the above-described one. Accordingly, in this case, the cylindrical electrodes 91 and 92 and the middle plate electrode 10 can be stacked. It is to be noted that if the middle plate electrode 10 is located approximately in the middle of the intermediate electrode 9, common components can be used for the cylindrical electrodes 91 and 92. In this case, the cylindrical electrodes 91 and 92 can be assembled so that the variabilities of the lengths of both cylindrical electrodes 91 and 92 compensate for each other. An example of this assembling method is exaggeratedly shown in FIGS. 7 and 8. FIG. 7 shows the cylindrical electrode 91 for the intermediate electrode 9. In this case, the cylindrical electrode 91 has a flange 911 on a side which faces the middle plate electrode 10. If the right-side and left-side dimensions of the cylindrical electrode 91 differ as indicated by D3 and D4, the variability of the component dimensions can be absorbed by assembling the intermediate electrode 9 with the cylindrical electrode 91 inverted from side to side. In this construction, even if the length of a cylindrical electrode component varies by 0.01 mm, the above-described voltage variability can be suppressed to 1.4 V. The electrodes of the electron gun are assembled by using so-called bead glass so that they can be electrically insulated from one another. The portion of each of the electrodes which is buried in the bead is called a bead support. A projecting portion 101 of the middle plate electrode 10 shown in FIG. 6 is buried in the bead glass as the bead support.

Figure 9:
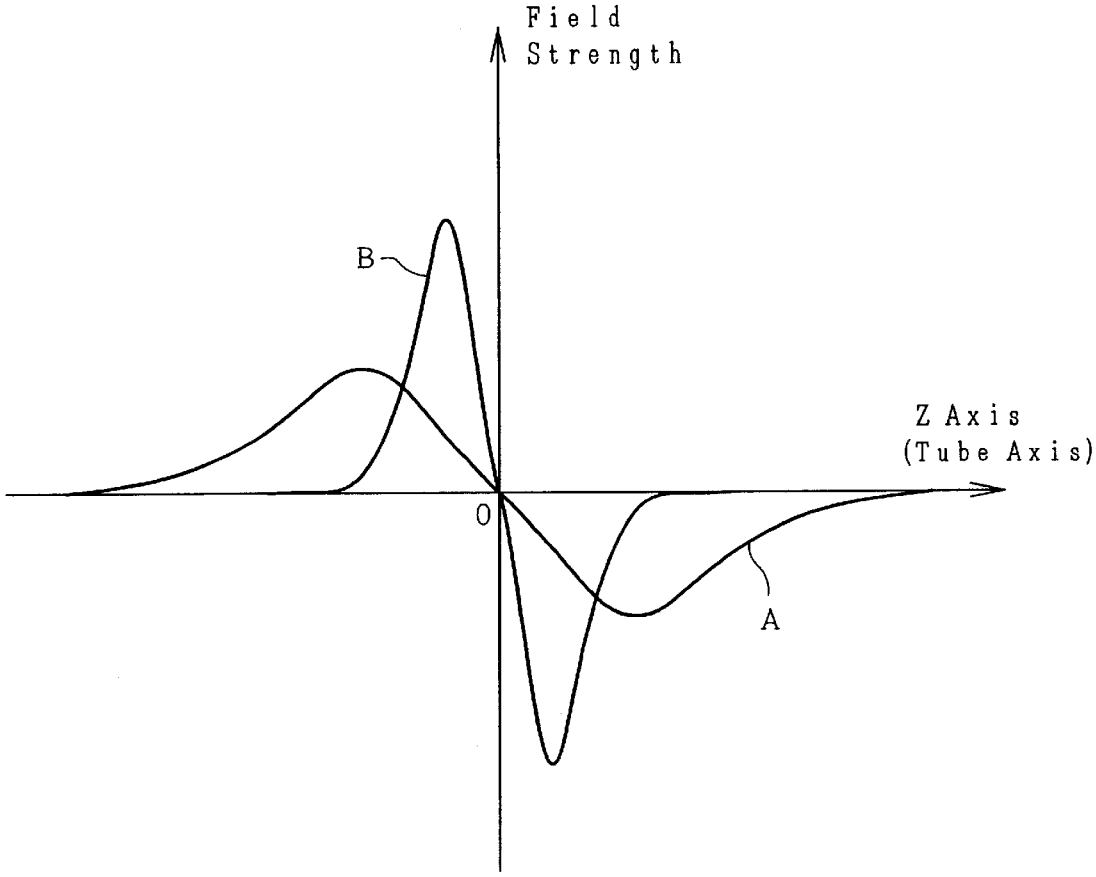
FIG. 9 is a diagram which shows the state of an electric field near the focus electrode.

FIG. 9 shows the state of an electric field near the main lens. In FIG. 9, a curve A represents the state of an electric field according to the present invention, and a curve B represents the state of an electric field in a case using no middle plate electrode. In FIG. 9, a point z=0 on the tube axis is the central point between the aperture of a focus electrode and the aperture of an anode electrode opposed to the focus electrode. In FIG. 9, the plus (upper) side shows a convergent electric field, and the minus (lower) side shows a divergent electric field. The variation in the electric field is far milder in the present invention than in the conventional example. In addition, by appropriately selecting the shapes of the inner plate electrodes 5 and 7 or the middle plate electrode 10 and the shapes of the respective holes, it is possible to exert a focus effect on the cross section of each electron beam.

Figure 10:
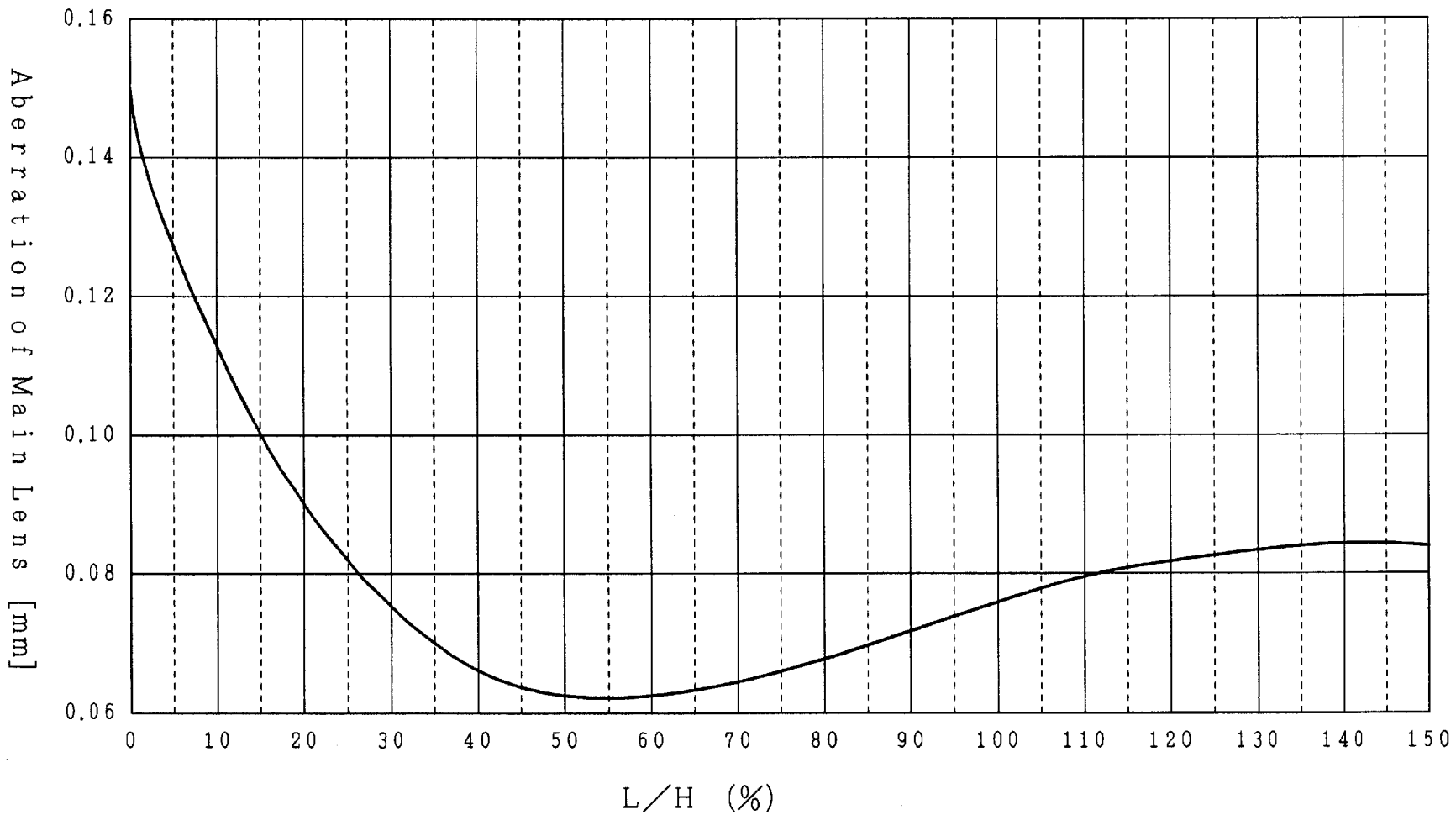
FIG. 10 is a characteristic diagram which shows the relationship between the shape of the intermediate electrode and lens aberration.
Figure 11A:
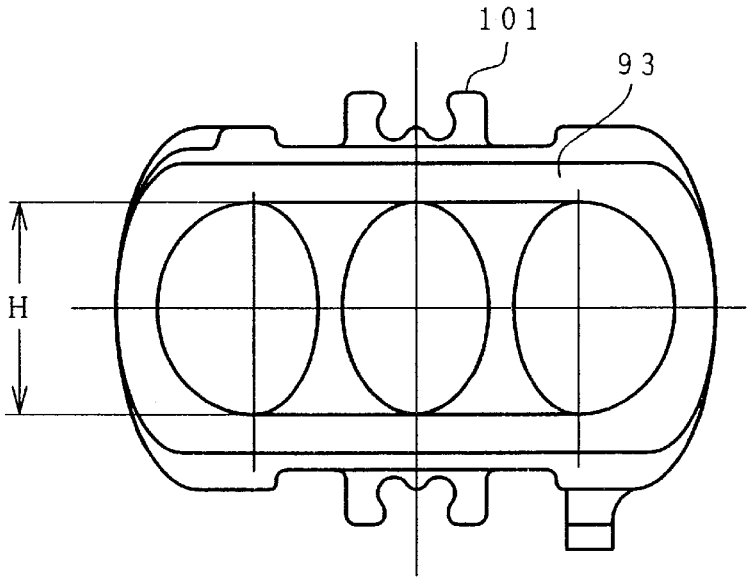
FIG. 11(*a*) is a front view, FIG. 11(*b*) is a plan view and FIG. 11(*c*) is a side view of the intermediate electrode.
Figure 11B:
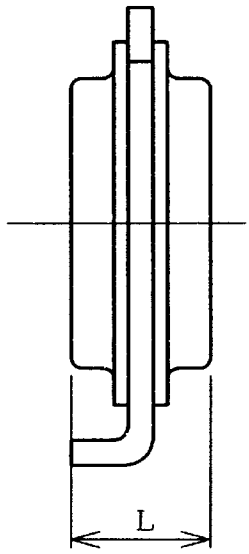
Figure 11C:
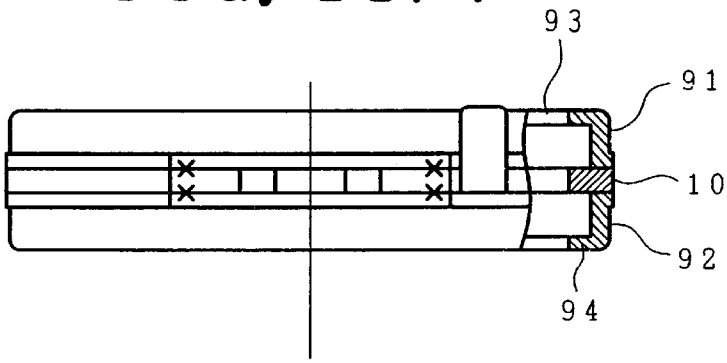

The influence of the aberration of the main lens on the beam spot size also varies depending on the L/H ratio of a diameter H of a single aperture of the intermediate electrode 9 measured in a direction perpendicular to the inline direction to a length L of the intermediate electrode 9 measured in the axial direction thereof. FIG. 10 shows the influence of the L/H ratio on the aberration of the main lens. As is apparent from FIG. 10, it is preferable that the value of the L/H ratio range from 40% to 75%, ideally, from 50% to 65%. FIG. 11 Shows a case in which rims 93 and 94 are formed on the focus-electrode side of the cylindrical electrode 91 and on the anode-electrode side of the cylindrical electrode 92 of the intermediate electrode 9, respectively. In this case, the diameter H may be the vertical diameter of the aperture of the rim as shown in FIG. 11. If the diameter of the single aperture measured in a direction perpendicular to the inline direction differs, the diameter of the aperture measured near the central electron beam may be used. If the single aperture of the intermediate electrode 9 differs between the focus-electrode side and the anode-electrode side, the diameter of the single aperture on the focus-electrode side is used.

Figure 12:
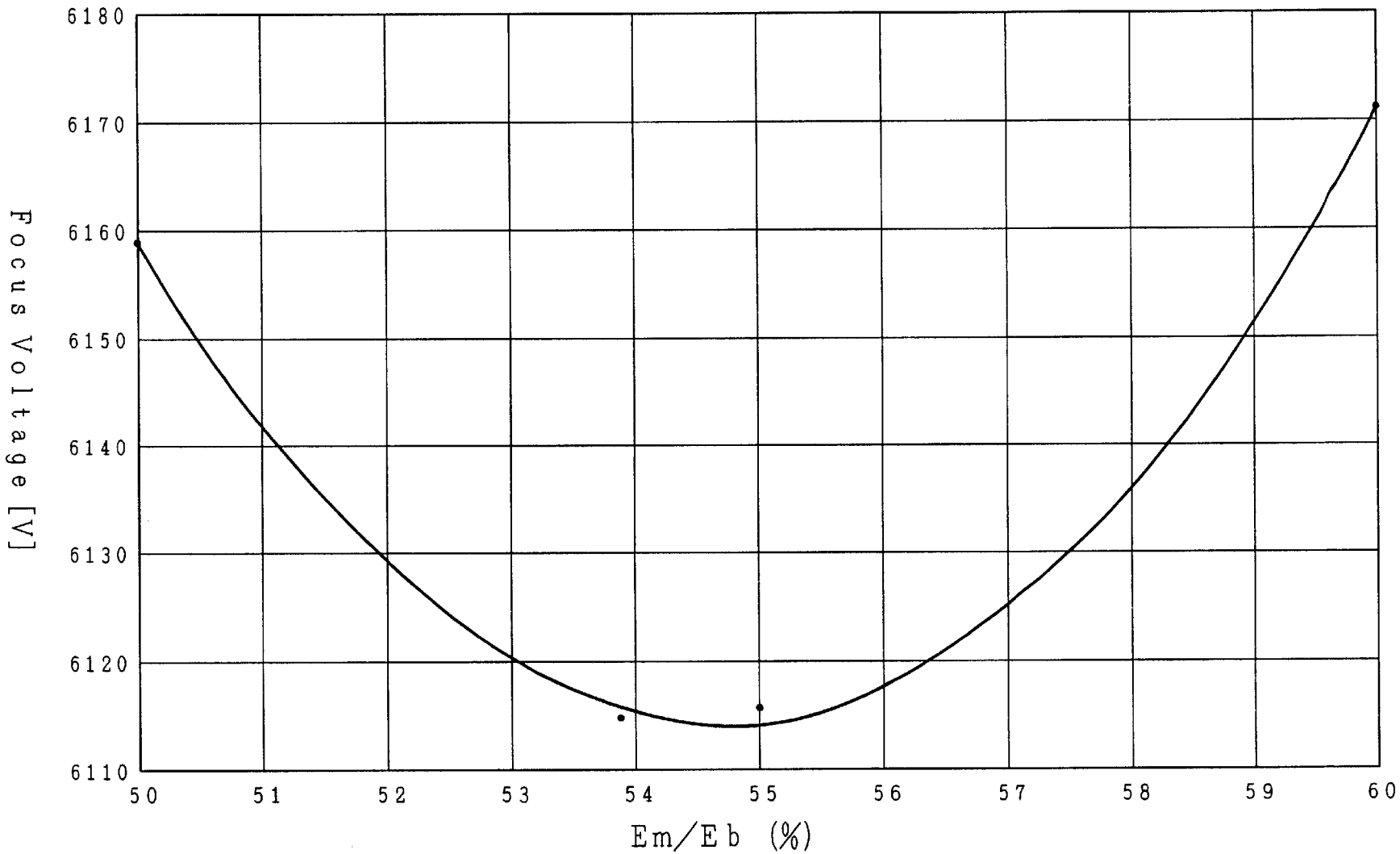
FIG. 12 is a characteristic diagram which shows the ratio of an intermediate electrode potential and an anode potential and the influence of the intermediate electrode potential on the variability of a focus voltage.

The potential of the intermediate electrode 9 is determined by dividing an anode voltage by means of a resistor built in the Braun tube. The voltage division ratio of the built-in resistor varies according to various conditions, and the focus characteristic varies according to the voltage division ratio. The variability of the focus characteristic has heretofore been a great problem. FIG. 12 shows a method of suppressing the variation of the focus characteristic according to the present invention. Specifically, if a variation in the voltage division ratio is allowed within a constant range, the influence on the focus characteristic can be made small by reducing the ratio of an intermediate electrode potential Em and an anode potential Eb to a certain value or less. From FIG. 10, it is seen that the Em/Eb ratio is preferably 52% to 58%, optimally 53% to 56%. Moreover, letting Ef be the focus voltage, a good result can be obtained when Ef is selected to satisfy $Eb/Em \approx Em/Ef$.

Figure 13:
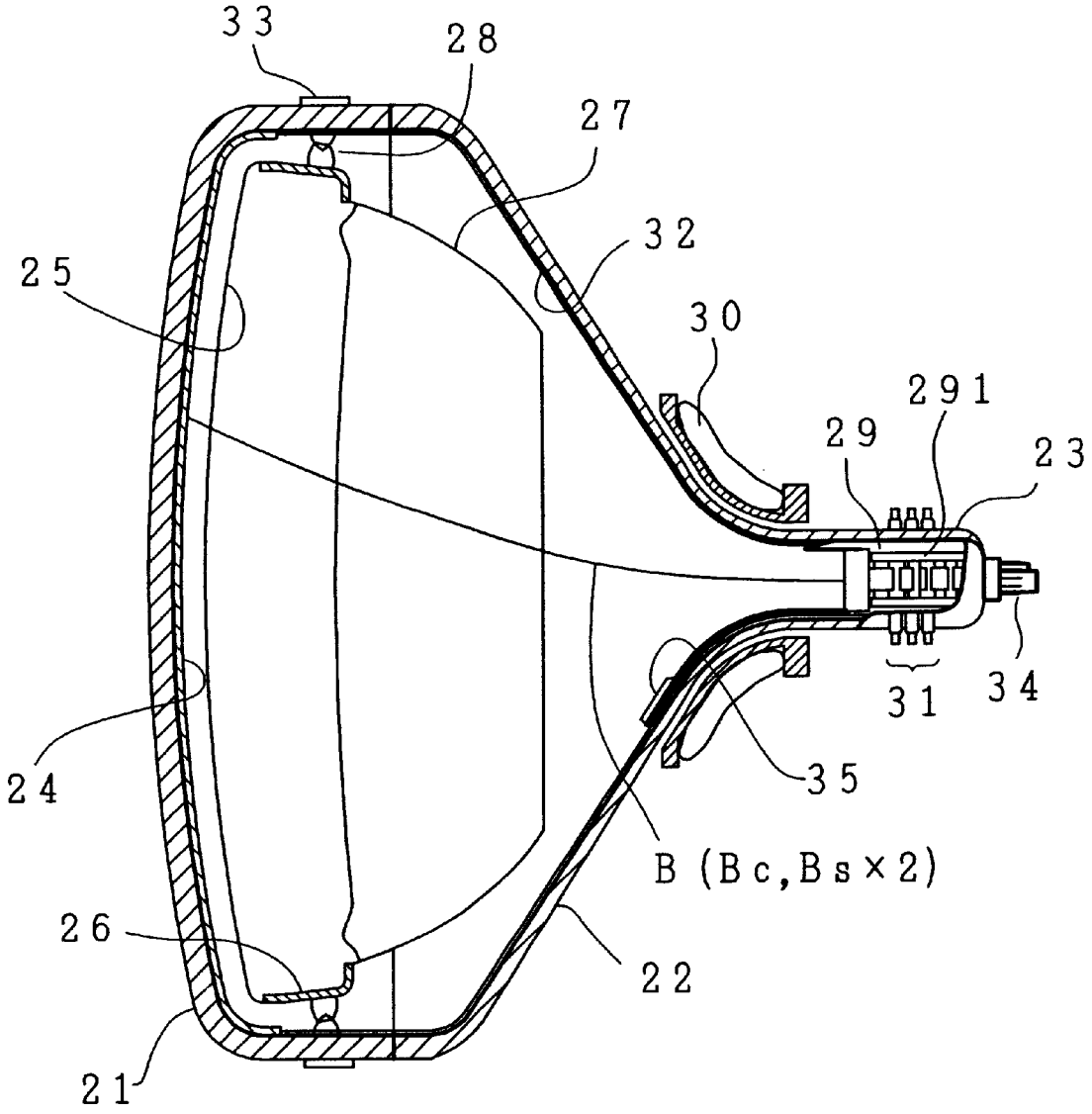
FIG. 13 is a axial sectional view of a color picture tube in which the electron gun according to the present invention is used.

FIG. 13 shows a color picture tube to which the present invention is applied. A vacuum envelope is formed of a glass panel 21, a funnel 22 and a neck 23. A fluorescent screen 24 is formed on the inner surface of the glass panel 21, and a shadow mask 25 is arranged to oppose the fluorescent screen 24. The shadow mask 25 is supported by a support frame 26, and the support frame 28 is secured to the glass panel 21 via springs 26. To decrease the influence of an outer magnetic field on the electron beams, an inner shield 27 is secured to the support frame 26. Each electrode of an electron gun 29 is assembled via a bead glass 291. An electron beam emitted from the electron gun 29 is deflected by a deflection yoke 30. A magnet assembly 31, which is secured to the neck portion is provided for adjusting the purity and convergence. The inner wall of the funnel 22 is coated with interior graphite 32 to hold the interior of the funnel 22 at a constant voltage. A reinforcing band 33 is provided for preventing the implosion of the Braun tube. Reference numeral 34 denotes a member which protects a pin for supplying voltage to each electrode of the electron gun. A getter 35 is flashed after the tube is evacuated so that the interior of the Braun tube is held at high vacuum. The outer diameter of the neck 23 is generally 29.1 mm, but a Braun tube of diameter 25.3 mm or less also needs to be used to decrease deflecting electric power. The limitation of the lens diameter of the main lens becomes serious, particularly when the outer diameter of the neck 23 is small. The present invention is particularly effective in Braun tubes having a neck diameter of 25.3 mm or less.

What is claimed is:

1. A color picture tube comprising:

a panel having a fluorescent screen;

a neck which accommodates an electron gun;

a funnel which connects said panel and said neck; and a vacuum envelope constituted by said panel, said neck and said funnel;

said electron gun having a cathode for generating three electron beams arrayed in an inline direction, a control electrode, an accelerating electrode and a main lens for focusing the electron beams on the fluorescent screen;

said main lens being formed by a focus electrode to which a focus voltage is to be applied, an intermediate electrode to which an intermediate voltage between the focus voltage and an anode voltage is to be applied, and an anode electrode to which the anode voltage is to be applied;

said focus electrode being cylindrical and having a fluorescent-screen side aperture which is a single aperture which surrounds the three electron beams in common, an inner plate electrode being secured to an inner wall of said focus electrodes, thickness direction of said inner plate electrode being coincident with an axial direction of said electron gun, passages of the respective three electron beams being formed by said inner plate electrode;

said intermediate electrode being made of a focus-electrode side cylindrical electrode, a middle plate electrode and an anode-electrode side cylindrical electrode, said middle plate electrode having a stacked structure sandwiched between said focus-electrode side cylindrical electrode, the passages of the respective three electron beams being formed by said middle plate electrode, each of said focus-electrode side cylindrical electrode having a single aperture common to the three electron beams;

said anode electrode being cylindrical and having a fluorescent-screen side aperture which is a single aperture which surrounds the three electron beams in common, an inner plate electrode being secured to an inner wall of said anode electrode, a thickness direction of said inner plate electrode being coincident with an axial direction of said electron gun, the passages of the respective three electron beams being formed by said inner plate electrode.

2. A color picture tube according to claim 1, wherein each of said inner plate electrode in said focus electrode, said inner plate electrode in said anode electrode and said middle plate electrode in said intermediate electrode has a central hole through which to pass a central electron beam, the diameter of said central hole measured in the inline direction being smaller than the diameter of said central hole measured in a direction perpendicular to the inline direction.

3. A color picture tube according to claim 1, wherein said middle plate electrode is positioned approximately in the middle of said intermediate electrode.

4. A color picture tube according to claim 3, wherein said focus-electrode side cylindrical electrode and said anode-electrode side cylindrical electrode of said intermediate electrode use common components.

5. A color picture tube according to claim 4, wherein said focus-electrode side cylindrical electrode and said anode-electrode side cylindrical electrode are assembled into said intermediate electrode in such a way as to compensate for a component manufacturing error.

6. A color picture tube according to claim 1, wherein the ratio of a length L of said intermediate electrode measured in an axial direction of said electron gun to a diameter H of the focus-electrode side single aperture measured in a direction perpendicular to the inline direction is:

$$0.45 \leqq L/H \leqq 0.7.$$

7. A color picture tube according to claim 6, wherein the L/H ratio is:

$$0.50 \leqq L/H \leqq 0.60.$$

8. A color picture tube according to claim 6, wherein letting Em and Eb be a voltage to be applied to said intermediate electrode and a voltage to be applied to said anode electrode, respectively, $$0.52 \leqq Em/Eb \leqq 0.58.$$

9. A color picture tube according to claim 8, wherein the relationship between said Em and said Eb is:

$$0.53 \leqq Em/Eb \leqq 0.56.$$

10. A color picture tube according to claim 1, wherein letting Em, Eb and Ef be a voltage to be applied to said intermediate electrode, a voltage to be applied to said anode electrode and a voltage to be applied to said focus electrode, respectively $$Eb/Em \approx Em/Ef.$$

11. A color picture tube according to claim 1, wherein the thickness direction of said middle plate electrode is coincident with the axial direction of said electron gun.

12. A color picture tube according to claims 1 to 11, wherein said neck has an outer diameter of 25.3 mm or less.

* * * * *